US006367201B1

(12) United States Patent
Massey et al.

(10) Patent No.: US 6,367,201 B1
(45) Date of Patent: Apr. 9, 2002

(54) WIDTH ADAPTABLE THRESHOLD ASSEMBLY

(75) Inventors: Victor T. Massey; Bruce E. Procton, both of Greensboro, NC (US)

(73) Assignee: Endura Products, Inc., Greensboro, NC (US)

( * ) Notice: Subject to any disclaimer, the term of this patent is extended or adjusted under 35 U.S.C. 154(b) by 0 days.

(21) Appl. No.: 09/523,026

(22) Filed: Mar. 10, 2000

(51) Int. Cl.[7] ..... E06B 1/70
(52) U.S. Cl. ..... 49/467
(58) Field of Search ..... 49/467, 468, 505, 49/470; 52/212, 204.1, 204, 54, 60, 97

(56) References Cited

U.S. PATENT DOCUMENTS 1,910,260 A * 5/1933 Reher ..... 49/467
2,089,380 A * 8/1937 Kammerer ..... 49/468
2,167,958 A * 8/1939 Oftedal et al. ..... 49/468
3,032,837 A * 5/1962 Ramsey ..... 49/468
3,402,512 A * 9/1968 Peterson ..... 49/468
3,762,100 A * 10/1973 Kempel ..... 49/468
3,962,828 A * 6/1976 McAllister ..... 49/468
4,411,104 A * 10/1983 St. Aubin ..... 49/467 X
5,611,173 A * 3/1997 Headrick et al. ..... 49/468
5,673,517 A * 10/1997 Stanclift ..... 49/468

* cited by examiner

*Primary Examiner*—Jerry Redman
(74) *Attorney, Agent, or Firm*—Womble Carlyle Sandridge & Rice, PLLC

(57) ABSTRACT

A width adaptable threshold and sill assembly has an elongated extruded aluminum body profiled to define an upwardly open channel from which a sloped sill extends outwardly to an edge. An edge plate projects further outwardly from beneath the edge of the sill to an extreme outside edge of the assembly. An extender plate is selectively attachable to the edge plate to extend the body in an outside direction to accommodate wider entryways for inswing doors. Alternatively, an extender nose is selectively attachable to the inside edge of the body to extend the body in an inside direction to accommodate wider entryways for outswing doors.

2 Claims, 5 Drawing Sheets

WIDTH ADAPTABLE THRESHOLD ASSEMBLY

TECHNICAL FIELD

This invention relates generally to door and entryway systems and more particularly to threshold and sill assemblies for such systems.

BACKGROUND

Entryways in modern residential and commercial buildings generally are provided with an extruded aluminum threshold and sill assembly that defines an upwardly open channel extending across the threshold, and a sill that slopes outwardly and downwardly from the channel to an outside edge of the assembly. The channel is configured to support a variety of interchangeable components including, but not limited to, a vertically adjustable threshold cap for underlying a closed door of the entryway, a fixed panel cap for underlying and supporting a sidelight panel or fixed door, or an outswing cap for abutting and sealing against an outswing door mounted in the entryway. Many times, these components are formed of extruded plastic, although they may be formed of wood, metal, or another material if desired. Such threshold and sill assemblies have been very successful and have virtually replaced old fashion wooden or simple metal thresholds.

Another trend in modern construction is for the walls of certain buildings to be made thicker than has been traditional over the years. This is done for a variety of reasons including to accommodate thicker bats of insulation for providing the highest possible R-value for the building as a whole. Generally, forming thicker walls is accomplished by replacing traditional 2×4-inch framing studs with wider studs such as, for example, 2×6-inch studs. Insulation value can also be added by installing one-inch sheets of insulating material such as expanded foam on the exterior portion of the building underlying the external siding. It can thus be seen that the wall thickness in modern buildings can vary depending upon the thickness of the framing studs and/or the use of additional layers of insulating material. Naturally, buildings with thicker walls have entryways that are deeper in a direction from the outside wall to the inside wall of the building than the entryways of buildings with standard width walls. Further, traditional 2×4-inch framing and insulating techniques are still widely used, especially in milder climates where added insulation is not needed, such that standard width entryways are very common as well.

The varying possible thickness of walls and correspondingly varying depths of entryways has given rise to the need for threshold and sill assemblies of various widths to match the depth of an entryway in which they are to be installed. This causes problems for fabricators and suppliers of threshold and sill assemblies and for fabricators of entryway systems because a variety of designs must be made and stocked to accommodate the various types and depths of entryways. For example, a fabricator generally must stock a traditional width threshold and sill assembly as well as assemblies that are extended in width along their outside edges to accommodate different depth entryways with inswing doors. Other styles that are extended in width along their inside edges must be stocked for incorporation into differing depth entryways with outswing doors. Since entryways generally can be one of three possible standard depths, it can be seen that an array of size and style combinations generally must be fabricated and stocked to accommodate the various possibilities. Obviously, this increases manufacturing costs and complexity, complicates warehousing requirements, and requires that fabricators of entryway systems order carefully to insure that threshold and sill assemblies of the proper width are available for installation in the various depths and styles of entryways.

Thus, a need exists for a modern threshold and doorsill assembly that eliminates the need to fabricate and stock a wide variety of widths and styles of such assemblies to accommodate different wall thicknesses and corresponding entryway depths. It is to the provision of a threshold and sill assembly that addresses these and other problems and shortcomings that the present invention is primarily directed.

SUMMARY OF THE INVENTION

The present invention is an improved threshold and doorsill assembly that is easily adaptable for use in entryways having a variety of depths resulting from different possible wall thicknesses. The assembly of this invention is particularly suitable for use with exterior French and patio door systems having sliding exterior screens. However, this certainly is not a limitation of the invention, which also can be used as the threshold and sill of a conventional door.

Briefly described, the threshold and sill assembly of this invention comprises an elongated extruded aluminum body adapted to be installed at the bottom of an entryway extending continuously between the bottoms of the vertical jambs thereof. The body defines an elongated upwardly open channel configured to receive a vertically adjustable threshold cap for underlying an openable door, a panel cap for underlying and supporting a fixed door or panel, or an outswing cap and weather strip assembly for abutting and sealing against an outswing door. A sill extends outwardly and slopes downwardly from the upwardly open channel for shedding rainwater away from the entryway. The sill terminates in a forward edge forming a downturned nose with an undercut area behind the nose. An edge plate extends from beneath the undercut area to the extreme outside edge of the sill, which, in use, substantially aligns with or is just shy of the face of the brick mold that frames an entryway in which the threshold and sill assembly is installed.

The threshold and sill assembly has an initial width from its inside edge to its extreme outside edge that is appropriate for installation in an entryway of a building framed with standard 2×4 framing. In other words, when installed between the jamb bottoms of standard 4 9/16-inch jambs, the extreme outside edge of the edge plate substantially aligns with or is just shy of the face of the brick mold of the entryway as it should. However, the same threshold and sill assembly is easily adaptable for use with wider jambs installed in entryways of buildings framed with wider framing timbers such as, for example 2×6 framing studs. For this purpose, an extender plate is provided that securely attaches to the edge plate of the assembly and extends a predetermined distance beyond the extreme outside edge of the edge plate to a new extreme outside edge, which substantially aligns with the face of the brick mold attached to the wider jambs. The extender plate overlies and snaps into place on the edge plate so that it is easily installed to adapt the threshold and sill assembly of the invention for use with wider jambs.

In certain applications such as, for example, outswing patio or French doors, a wider jamb requires that the threshold and sill assembly be extended inwardly toward the inside of a building rather than outwardly. To accommodate such applications, the present invention also includes an extruded plastic extender nose adapted to snap onto the inside edge of the threshold and sill assembly where the traditional plastic nosing strip attaches in a conventional width entryway. When so attached, the extender nose projects inwardly from the threshold and sill assembly to an inside edge that substantially aligns with the inside edge of the jambs. The extender nose is easily installed since it is designed to be snapped into place on the threshold and sill assembly, where it is securely held by barbed projections that extend into attachment slots formed in the aluminum body of the assembly.

Thus, an improved threshold and sill assembly is now provided that successfully address the problems and shortcomings of the prior art. More specifically, the assembly of this invention is easily extendable in width to accommodate a variety of jamb widths and entryway depths either by snapping an extender plate along the outside edge of the sill or an extender nose along the inside edge of the assembly as required by the installation. These and other objects, features, and advantages of the invention will become more apparent upon review of the detailed description set forth below when taken in conjunction with the accompanying drawing figures, which are briefly described as follows.

DETAILED DESCRIPTION

Figure 1:
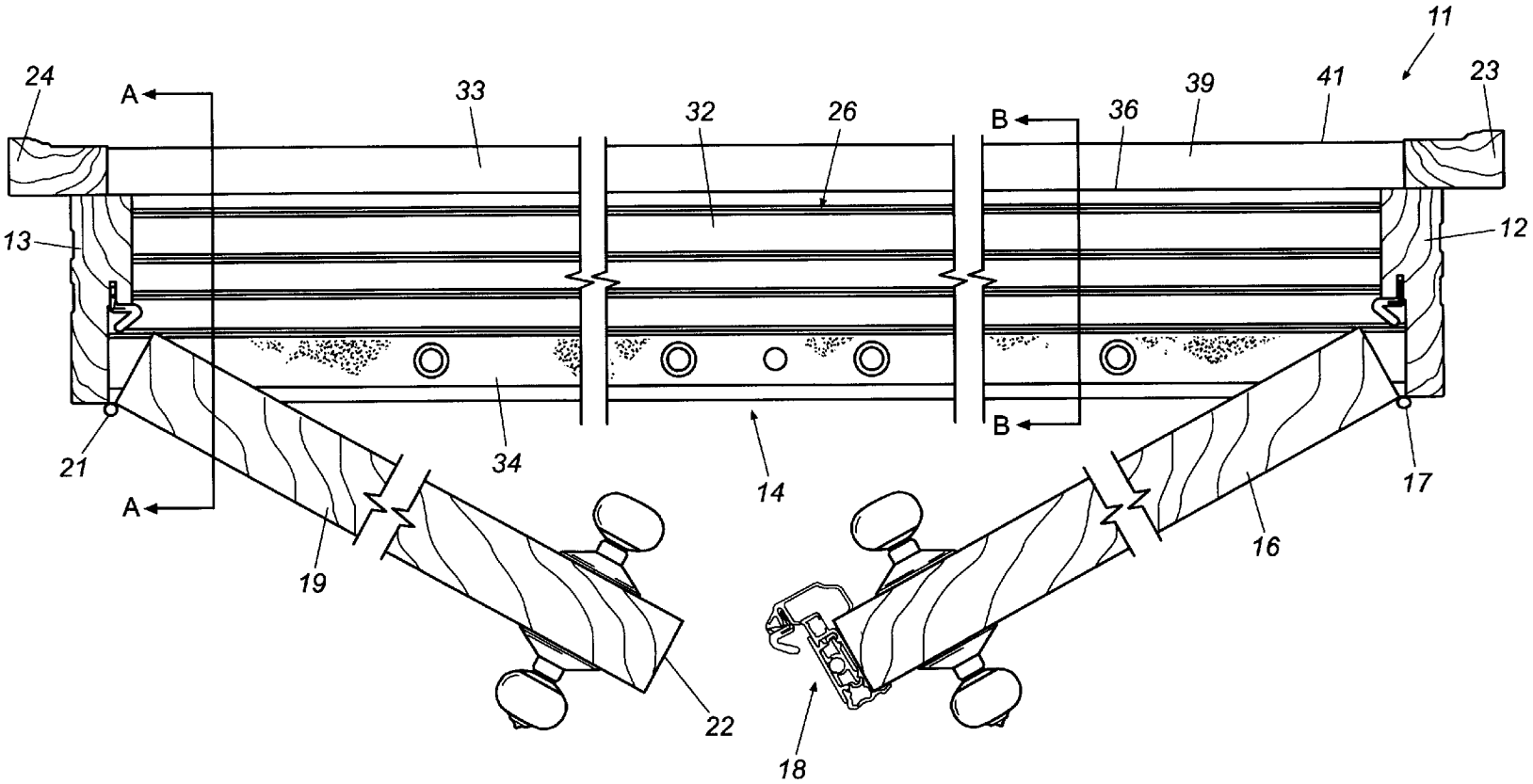
FIG. 1 is a top plan partially cross-sectional view of a traditional width inswing French door system that incorporates the threshold and sill assembly of the present invention.

Referring now in more detail to the drawing figures, in which like numerals refer to like parts throughout the several views, FIG. 1 illustrates a typical inswing French door entryway that incorporates principles of the present invention in a preferred form. The entryway 11, which is seen in a top plan partially cross-sectional view in FIG. 1, comprises a right jamb 12 and a left jamb 13. A head jamb (not shown) extends across the top ends of the left and right jambs 12 and 13 to complete the top of the entryway. A threshold and sill assembly 14 incorporating principles of the invention is attached to the bottoms of the jambs 12 and 13 and spans and covers the threshold of a building in which the entryway 11 is installed. A normally inactive door 16 is hingedly attached to the right jamb 12 by means of a hinge 17 and is adapted to swing inwardly into the building in which the entryway is installed. The normally inactive door 16 is provided with an astragal 18 along its vertical edge for locking the normally inactive door and for providing a stop against which the normally active door can be shut. The normally active door 19 is hingedly mounted by means of hinges 21 to the left jamb 13 and has a vertical edge 22 that shuts against the astragal 18 when the door 19 is closed. Brick mold 23 and 24 extends along and is attached to the outside edge of the jambs 12 and 13 in the traditional manner.

In general, the threshold and sill assembly 14 includes an elongated extruded aluminum body 26 defining an upwardly open channel 31 (FIGS. 2 and 3) from which a sill 32 extends outwardly and downwardly. The upwardly open channel 31 receives and positions a threshold cap 34, which preferably is vertically adjustable within the upwardly open channel. When disposed in the upwardly open channel 31, the threshold cap 34 is positioned to underlie the closed doors 16 and 19 of the entryway 11, which include sweeps for sealing against the threshold cap as a deterrent against drafts and windblown rain. The sloped sill 32 extends from the upwardly open channel to a downturned forward edge 36. An edge plate 39 extends from below the downturned forward edge 36 to an extreme outside edge 41 of the threshold and sill assembly.

Figure 2:
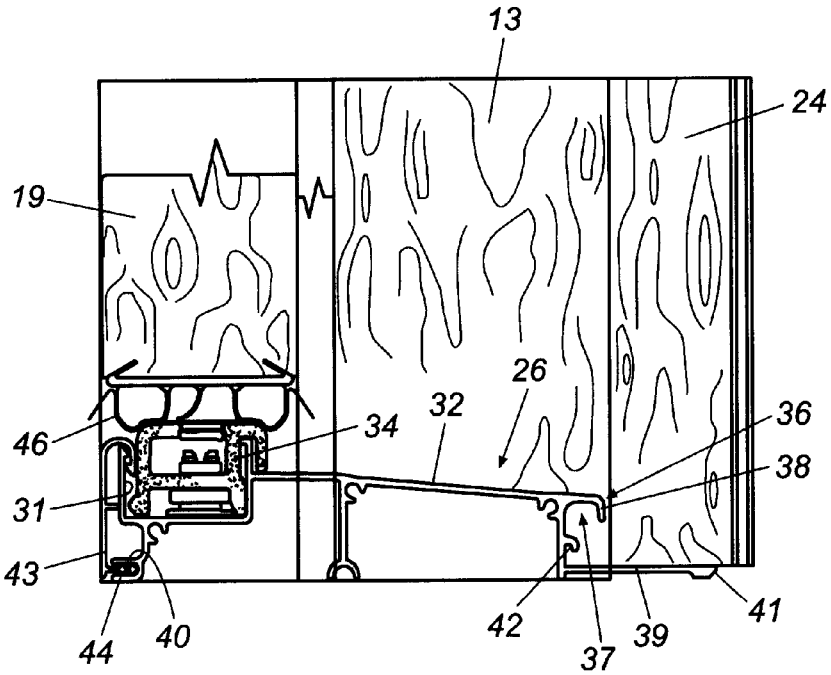
FIG. 2 is a section taken along A—A of FIG. 1 with the door shut and showing the profile of the threshold and sill assembly.
Figure 3:
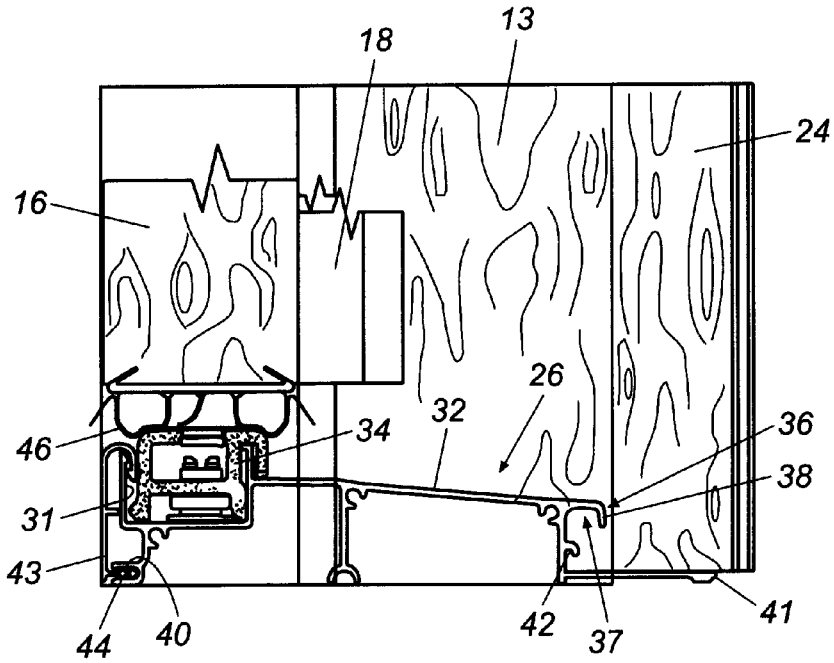
FIG. 3 is a section taken along B—B of FIG. 1 illustrating the profile of the threshold and sill assembly and showing the astragal of the normally inactive door.

As better seen in FIGS. 2 and 3, the forward edge 36 of the sill 32 preferably is configured with a downturned lip 38. The forward edge 36 may just as well terminate at a stark edge or some other shape if desired, although the downturned lip provides a natural drop edge and is preferred. The edge plate 39 projects further outwardly from beneath the forward edge 36 to an extreme outside edge 41 of the assembly, which preferably aligns substantially or is just shy of the outside face of the brick mold 24. This configuration provides a pleasing aesthetic appearance and insures that rain water is drained completely away from the entryway. A recess 42 is formed along and just above the back edge of the edge plate 39 for purposes described in detail below.

The closed doors 16 and 19 of the entryway are provided along their respective bottom edges with flexible rubberized sweeps 46 that bear and seal against the threshold cap 34 when the doors are shut. A nosing strip 43 covers the inside portion of the threshold and sill assembly and preferably is formed of extruded plastic. The nosing strip is secured to the assembly by means of a projecting barbed tang 40, which extends into a corresponding elongated slot 44 formed along the back of the assembly. The top of the nosing curves over and is nestled with the top portion of the upwardly open channel between the back wall of the channel and the threshold cap. This configuration both holds the nosing strip firmly in place and helps secure the threshold cap within the upwardly open channel as shown.

It will be understood that FIGS. 1 through 3 illustrate a threshold and sill assembly configured according to the present invention and sized to be installed in the entryway of a building with traditional width framing. For example, this assembly is suitable for installation in a standard 4 9/16-inch opening where inswing French doors are to be installed.

Figure 4:
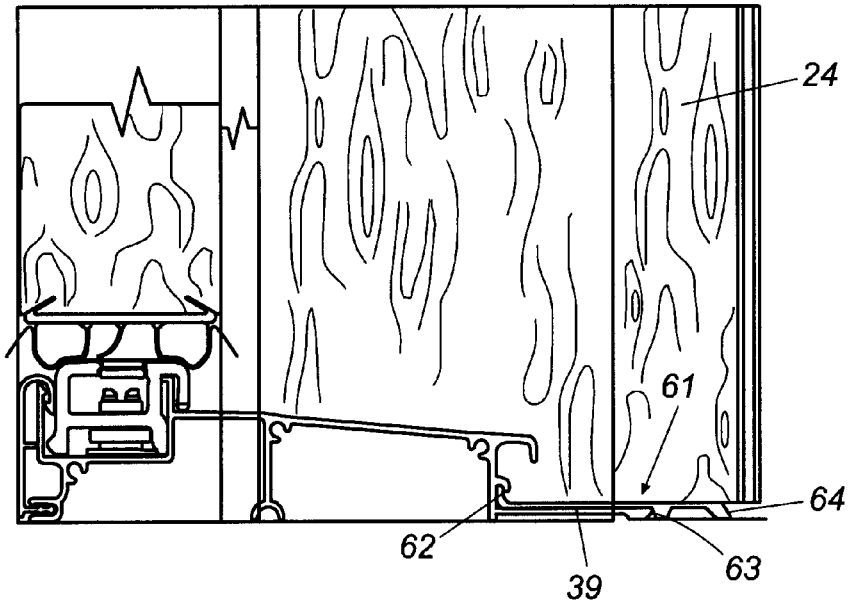
FIG. 4 is a cross-sectional view of the threshold and sill assembly of this invention installed in a wider inswing entryway illustrating the use of the extender plate to extend the width of the assembly.

FIG. 4 illustrates the threshold and sill assembly of this invention adapted for use with an entryway framed with wider framing studs such as, for example, a 5 ¼-inch inswing French door entryway. In this figure, the elongated aluminum body with its upwardly open channel and sloped sill are the same as in FIGS. 1 through 3 as is the vertically adjustable threshold cap, the door, and the sweep on the bottom of the door. The sill preferably terminates at its forward edge 36 in a downturned lip.

Since the threshold and sill assembly of FIG. 4 is installed in a deeper-than-standard entryway with correspondingly wider jambs, the assembly itself must be wider in order that its extreme outside edge substantially aligns with the face of the brick mold framing the entryway as required. For this purpose, an extender plate 61 is provided. The extender plate 61, which preferably is formed of extruded aluminum, is an elongated generally flat plate formed with an upturned back edge 62 and an undercut notch 63 along its bottom side. The upturned back edge 62 of the extender plate is sized to be received and securely held in the elongated recess 42 (FIG. 3) formed beneath the forward edge 36. The undercut notch 63 along the bottom side of the extender plate is positioned and configured to snap over the extreme outside edge of the edge plate 39 to hold the extender plate securely in place on the edge plate. With this configuration, it will be seen that the extender plate 61 attaches securely to and covers the edge plate 39 and extends forwardly to define a new extreme outside edge 64 of the threshold and sill assembly. This new extreme outside edge 64 aligns properly with the brick mold 24 of the wider entryway to assure proper appearance and drainage.

Thus it will be seen that the threshold and sill assembly of this invention is easily adaptable to the deeper entryway of a building with wider than standard framing simply by snapping the extender plate 61 onto the edge plate 39. The necessity of manufacturing and stocking threshold and sill assemblies of various widths to accommodate different framing standards is thus eliminated, thereby improving the efficiency and economy of the manufacturing and entryway fabrication operations.

Figure 5:
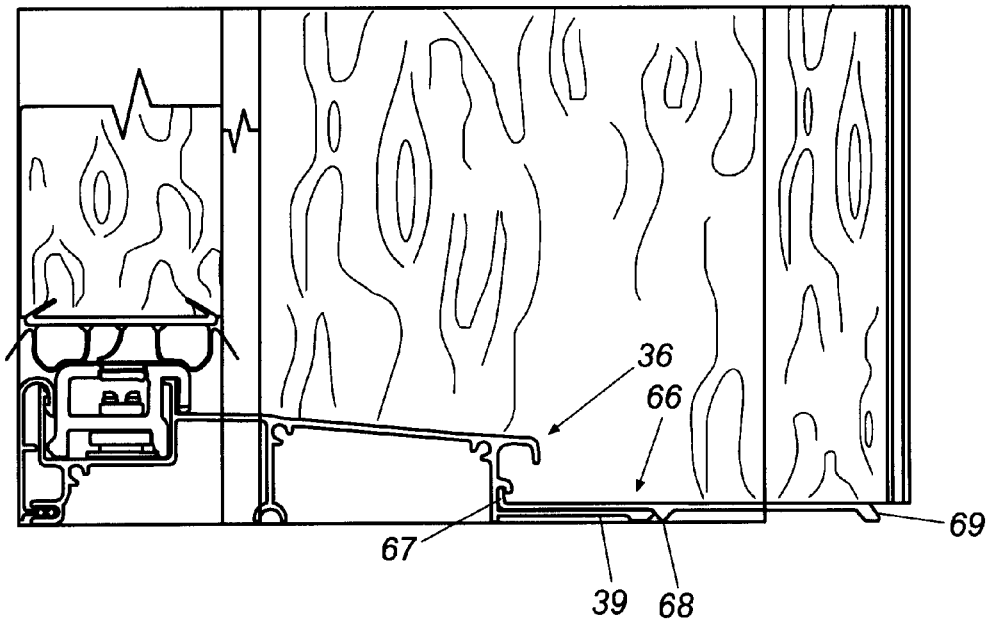
FIG. 5 is a cross-sectional view of the threshold and sill assembly of this invention installed in a still wider entryway illustrating use of a yet wider extender plate to adapt the assembly to the wider jambs of the entryway.

FIG. 5 illustrates the threshold and sill assembly of this invention installed in an inswing entryway of a building framed with yet wider studs such as, for example, in a 6 9/16-inch inswing French door entryway. Most aspects of the assembly of FIG. 5 are the same as those of FIG. 4 except that in this case a wider extender plate 66 is snapped into place on the edge plate 39. The wider extender plate is similar to the extender plate 61 of FIG. 4 and includes an upturned back edge 67 for being received in the recess 42 (FIG. 3) beneath the edge 36 and an elongated undercut notch 68 along its bottom side for snapping onto the outside edge of the edge plate 39. In this case, however, the extender plate is wider and extends to an extreme outside edge 69 of the threshold and sill assembly that, again, aligns properly with the brick mold of the entryway. Thus, the same basic threshold and sill assembly is width adaptable by snapping the appropriate extender plate in place to conform the assembly to an entryway of virtually any depth.

Figure 6:
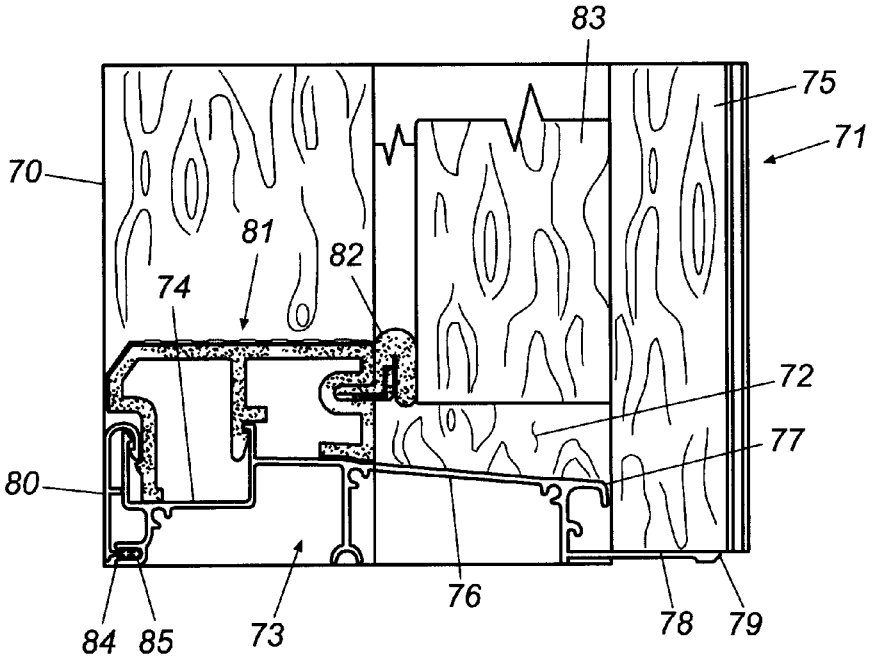
FIG. 6 is a cross-sectional view illustrating use of threshold and sill assembly of this invention in a traditional width outswing door installation.
Figure 7:
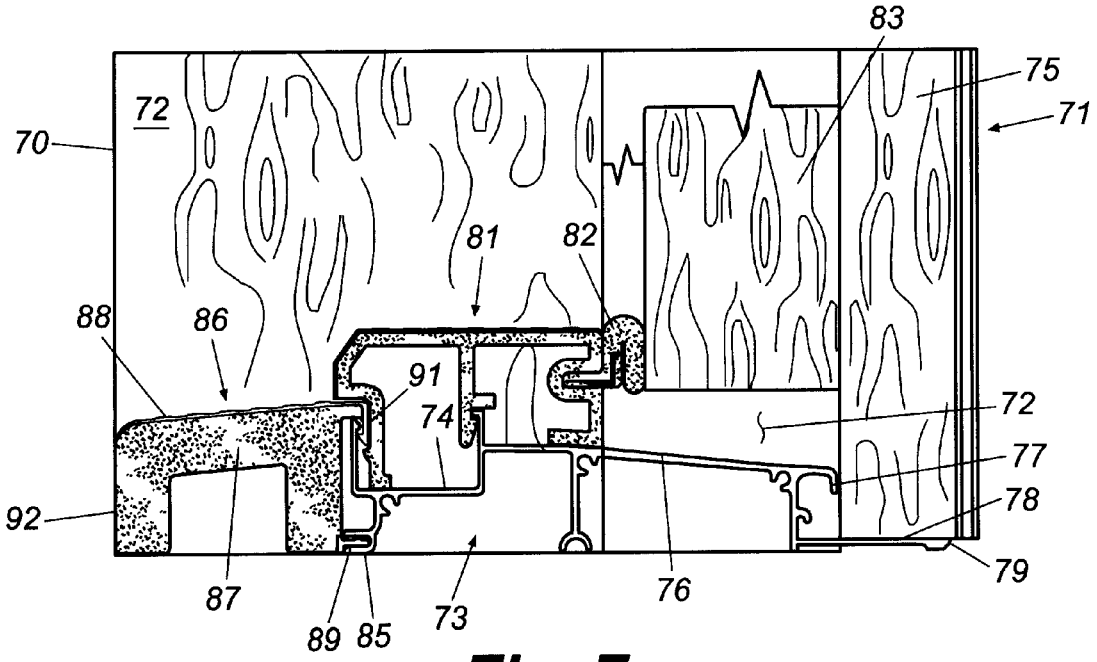
FIG. 7 is a cross-sectional view illustrating use of the extender nose of the invention to adapt the threshold and sill assembly to a wider outswing entryway.

FIGS. 6 and 7 illustrate the basic threshold and sill assembly of this invention adapted for use with outswing French door entryways of different depths. In FIG. 6, the assembly is installed in a standard 4 9/16-inch entryway 71. The assembly 73 comprises the same elongated extruded aluminum body defining an upwardly open channel 74 and a sill 76 extending outwardly and sloping downwardly from the channel to a downturned edge 77. An edge plate 78 extends from beneath the downturned edge 77 to an extreme outside edge 79 of the threshold and sill assembly, which is properly aligned with the brick mold of the entryway. An outswing cap 81 is mounted and secured within the upwardly open channel 74. The outswing cap 81 preferably is formed of extruded plastic material and includes an elongated slot along its outside edge for receiving and holding a length of weather stripping 82 positioned to seal against a closed door of the entryway.

The inside edge of the threshold and sill assembly 73 is covered by a plastic nosing strip 80, which is formed with a barbed tang 84 adapted to extend and be held in an elongated slot 85 to hold the nosing strip 80 securely in place. The top portion of the nosing strip 80 curves over and extends into the upwardly open channel between the channel wall and the cap 81. In this way, the nosing 80 and the cap 81 are each held securely in place on the body of the threshold and sill assembly. Further, the inside edge of the assembly is seen to be properly aligned with the inside edge 70 of the vertical jamb of the entryway, as is required.

FIG. 7 illustrates the threshold and sill assembly of this invention adapted for use in a wider-than-standard outswing French door entryway. In such entryways, the doors generally are positioned the same distance from the outside of the entryway as in standard width entryways. Accordingly, in wider outswing entryways it is necessary that the threshold and sill assembly be extended in width inwardly toward the inside of the building to accommodate the wider jambs of the entryway. To adapt the threshold and sill assembly of this invention to such entryways, an extender nose 86 is provided. The extender nose 86 preferably is extruded from plastic material and has a relatively less dense blown plastic core 87 and a relatively more dense non-blown plastic skin 88, although it may be formed of different materials. An elongated barbed tang 89 is co-extruded along the bottom of the forward edge of the extender nose 86 and is positioned to extend into and lock within the elongated groove 85 formed along the back of the aluminum body of the assembly. An elongated tab 91 is co-extruded along the top of the forward edge of the extender nose 86 and is positioned to extend into the upwardly open channel 74 and wedge between the rear wall of the channel and the outswing cap 81. Thus, the extender nose mounts securely on the assembly in place of the nosing strip 80 (FIG. 6). The extender nose 86 thus is firmly secured in place along the inside edge of the aluminum body and extends inwardly to an inside edge 92 that properly aligns with the inside edge 70 of the wider entryway jamb as required.

In use, extender noses of differing widths are provided to adapt the threshold and sill assembly of the present invention to outswing entryways of buildings framed with different width framing timbers. For example, extender noses to adapt the assembly for installation in 5¼-inch and 6 9/16-inch wide entryways preferably are provided. Custom width extender noses may also be fabricated when necessary to adapt the assembly for installation in outswing entryways of virtually any width.

From the forgoing it is seen that the present invention provides a single threshold and sill assembly configuration that is width adaptable to entryways of different widths, be they inswing or outswing entryways.

Figure 8:
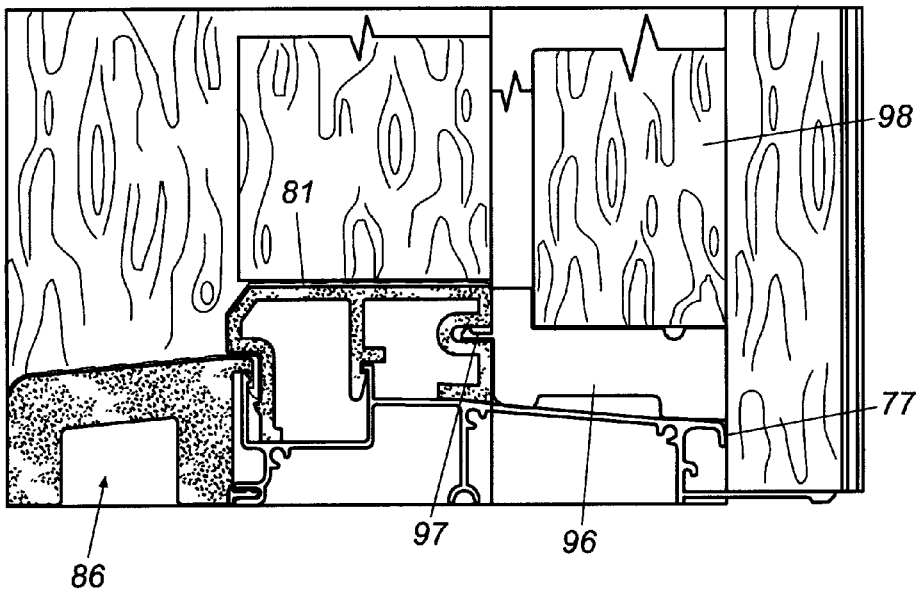
FIG. 8 is a cross-sectional view illustrating use of the present invention with the fixed door of a wider outswing patio door entryway.
Figure 9:
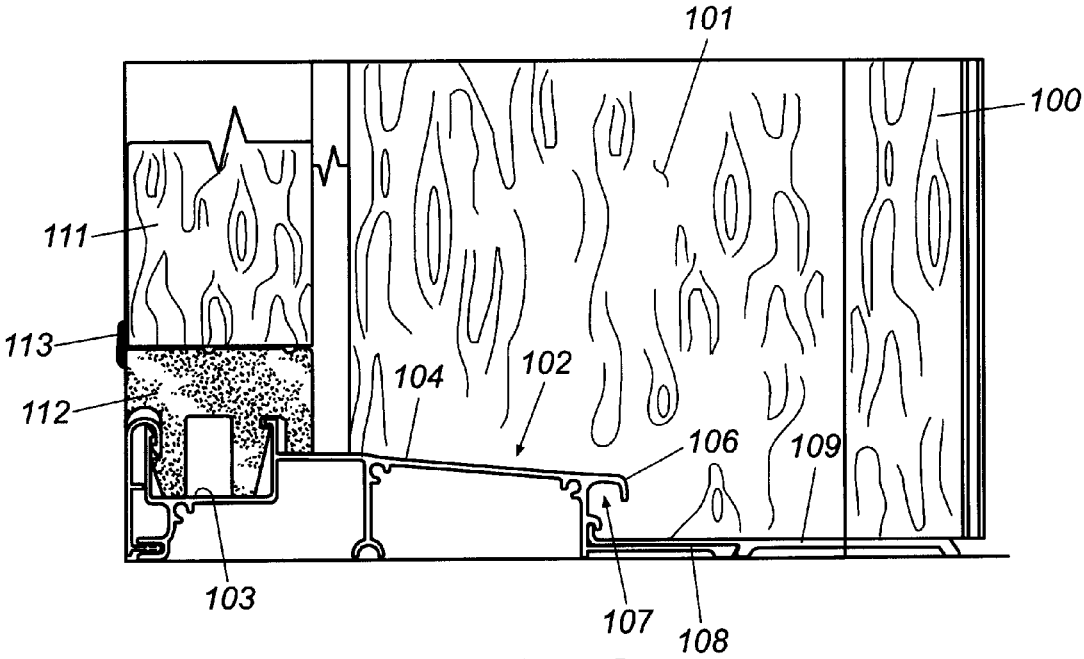
FIG. 9 is a cross-sectional view illustrating the portion of the present invention that underlies the fixed door of an inswing patio door entryway showing use of the edge plate extender to adapt the assembly for use with a wide entryway.

As illustrated in FIGS. 8 and 9, the threshold and sill assembly of the invention also is adaptable for use with other types of door configurations. For example, the assembly is adaptable for use with single fixed inswing and outswing doorways (having one fixed non-operable door and one hinged door), doors with panels such as sidelights, and multiple door French and patio doors with vertical mullions. FIG. 8 illustrates adaptation of the assembly of this invention to a single fixed outswing patio door and shows a longitudinal section through the fixed inoperable door of the entryway. The fixed door 98 is supported on the sill of the assembly by an elongated support block 96, which preferably is formed of extruded or injection molded plastic material. The support block is formed with a rearwardly projecting barbed tang 97, which extends into and is held within the elongated groove that holds the weather strip for sealing against the active door. The fixed door 98 and support block 96 extend forwardly to align with the outside edge 77 of the sloped sill and the support block is shaped to sit atop the sloped sill and to provide a level upper surface for supporting the fixed door. As in FIG. 7, an extender nose 86 is attached along the inside edge of the aluminum body of the assembly to adapt the assembly for installation in a deeper-than-standard entryway as described above.

FIG. 9 illustrates the threshold and sill assembly of the invention installed in a deeper-than-standard entryway provided with a single fixed inswing door system. This figure is a longitudinal section through the fixed non-operable door (which could also be a fixed panel such as a sidelight panel). The fixed door 111 is supported atop a support cap 112 configured to rest in the upwardly open channel 103 of the elongated body 102. The support cap 112 preferably is formed of extruded plastic material and has downwardly depending legs that lock the support cap in place within the channel 103. A trim piece 113 can be integrally molded onto the support cap 112 if desired to provide a pleasing aesthetic appearance, to help align the door 111, and to aid in sealing against drafts. The threshold and door assembly of FIG. 9 is seen installed in a wider-than-standard entryway and width adapted for this purpose by extender cap 109 snapped into place on the edge cap 108. Thus, with the various caps, supports, extenders, and other components as described, the present invention provides a threshold and sill assembly system that is virtually universally adaptable to any multiple-door entryway system whether it be an inswing, outswing, patio, French, or panel door system and to entryways of virtually any depth.

The invention has been described herein in terms of preferred embodiments and methodologies. It will be understood by those of skill in the art, however, that a wide variety of additions, deletions, and modifications might be made to the illustrated embodiments without departing from the spirit and scope of the invention as set forth in the claims. For example, the particular configuration of the sill and its components certainly can be different from those illustrated and described. Further, while the invention has been described in terms of particular types of entryways such as patio doors, it clear is adaptable to and may be used with a wide variety of doorway designs other than those disclosed. Accordingly, while the illustrated embodiments represent the best mode known to the inventor for carrying out the invention, the invention itself is not limited by the specifics of the preferred and illustrated embodiments.

What is claimed is:

1. A width adaptable threshold and sill assembly comprising:

an elongated body for installation between the jamb bottoms of an entryway, said elongated body having an inside edge and being profiled to define an upwardly open channel for receiving a cap and a sill extending outwardly and sloping downwardly from said channel to an edge;

an edge plate extending outwardly from said edge of said sill to an extreme outside edge of said threshold and sill assembly;

at least one extender selectively attachable to said elongated body extending along the length thereof for extending the width of said body to adapt said assembly for use with jambs of a predetermined greater width;

said extender comprising an extender plate adapted to be attached to said edge plate of said elongated body to extend said body in an exterior direction, said extender plate being configured to snap into place on said edge plate; and wherein said extender plate has an upturned back edge for being received and held in a recess formed in said body and a notch formed along its underside, said notch being configured to snap securely over said extreme outside edge of said edge plate, said extender plate, when snapped onto said edge plate, covering said edge plate and extending beyond said extreme outside edge thereof to extend the width of said threshold and sill assembly.

2. A width adaptable threshold and sill assembly comprising:

an elongated body for installation between the jamb bottoms of an entryway, said elongated body having an inside edge and being profiled to define an upwardly open channel for receiving a cap and a sill extending outwardly and sloping downwardly from said channel to an edge;

an edge plate extending outwardly from said edge of said sill to an extreme outside edge of said threshold and sill assembly;

at least one extender selectively attachable to said elongated body extending along the length thereof for extending the width of said body to adapt said assembly for use with jambs of a predetermined greater width;

said extender comprising an extender nose attachable to said elongated body along said inside edge thereof to extend the width of said threshold and sill assembly in an interior direction; and wherein said extender nose is formed with a pair of protrusions sized and positioned to be received in selected crevices of said elongated body along said interior edge thereof for securing said extender nose securely in place on said body.

* * * * *